US008960819B2

(12) United States Patent
Brown

(10) Patent No.: US 8,960,819 B2
(45) Date of Patent: Feb. 24, 2015

(54) ULTRA LOW-PROFILE SPICE RACK

(71) Applicant: Peggy Brown Creative Consulting, LLC, Milwaukee, WI (US)

(72) Inventor: Margaret A. Brown, Milwaukee, WI (US)

(73) Assignee: Peggy Brown Creative Consulting, LLC., Milwaukee, WI (US)

( * ) Notice: Subject to any disclaimer, the term of this patent is extended or adjusted under 35 U.S.C. 154(b) by 0 days.

(21) Appl. No.: 13/732,799

(22) Filed: Jan. 2, 2013

(65) Prior Publication Data

US 2014/0183079 A1 Jul. 3, 2014
US 2014/0367293 A9 Dec. 18, 2014

Related U.S. Application Data

(60) Provisional application No. 61/582,640, filed on Jan. 3, 2012.

(51) Int. Cl.
*E06B 1/00* (2006.01)
*A47B 81/00* (2006.01)
*B65D 25/20* (2006.01)

(52) U.S. Cl.
CPC ..... *A47B 81/00* (2013.01); *B65D 25/20* (2013.01)
USPC ..... 312/321.5

(58) Field of Classification Search
USPC ..... 312/263, 264, 321.5, 405.1; 211/75, 211/85.2, 87.01, 119.004; 206/459.1, 206/459.5, 818; 222/142.3, 179.5
See application file for complete search history.

(56) References Cited

U.S. PATENT DOCUMENTS

| | | | | | |
|---|---|---|---|---|---|
| 2,795,357 | A | * | 6/1957 | Burton et al. | 222/173 |
| 2,964,201 | A | * | 12/1960 | Huffman | 211/115 |
| 3,982,716 | A | * | 9/1976 | Trees | 248/309.4 |
| 4,802,608 | A | * | 2/1989 | Hofmann | 222/142.1 |
| 5,096,272 | A | * | 3/1992 | Belokin et al. | 312/129 |
| 5,163,745 | A | * | 11/1992 | Zagata | 312/242 |
| 5,782,544 | A | * | 7/1998 | Johnson, Sr. | 312/7.2 |
| 6,131,772 | A | * | 10/2000 | Robbins et al. | 222/142.3 |
| 6,360,464 | B1 | * | 3/2002 | Tate | 40/621 |
| 6,626,303 | B1 | * | 9/2003 | Moodie | 211/70.7 |
| 7,007,818 | B2 | * | 3/2006 | Martin | 220/23.4 |
| 7,261,212 | B2 | * | 8/2007 | Sholem | 211/70.6 |
| 7,845,519 | B2 | * | 12/2010 | Newberry et al. | 222/153.07 |
| 2002/0088730 | A1 | * | 7/2002 | Galomb | 206/459.5 |
| 2010/0140129 | A1 | * | 6/2010 | Sanfilippo et al. | 206/503 |
| 2010/0243503 | A1 | * | 9/2010 | Krueger et al. | 206/459.5 |

FOREIGN PATENT DOCUMENTS

JP 5049515 * 3/1993

* cited by examiner

*Primary Examiner* — Matthew Ing
(74) *Attorney, Agent, or Firm* — Boyle Fredrickson, S.C.

(57) ABSTRACT

A spice rack for attaching to the inner surface of kitchen cabinet doors provides a low profile support and spice containers that may fit substantially within the gap between the cabinet door and the front of the shelves defined by a thickness of the face frame and a small clearance gap between the shelves in the rear of the face frame.

20 Claims, 8 Drawing Sheets

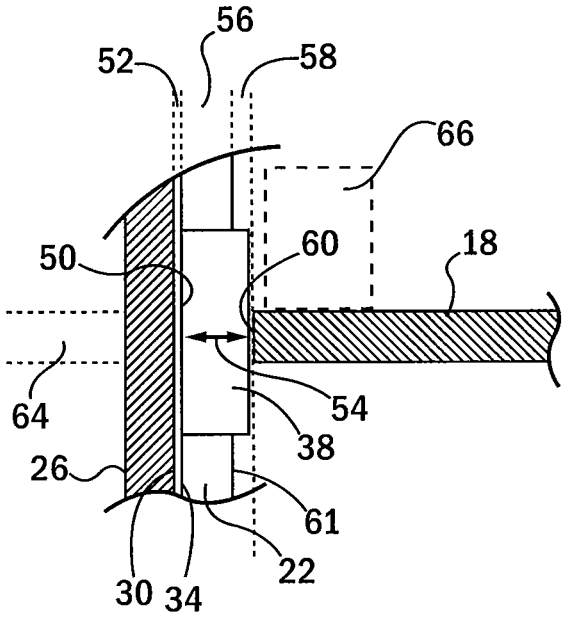
FIG. 3
FIG. 4
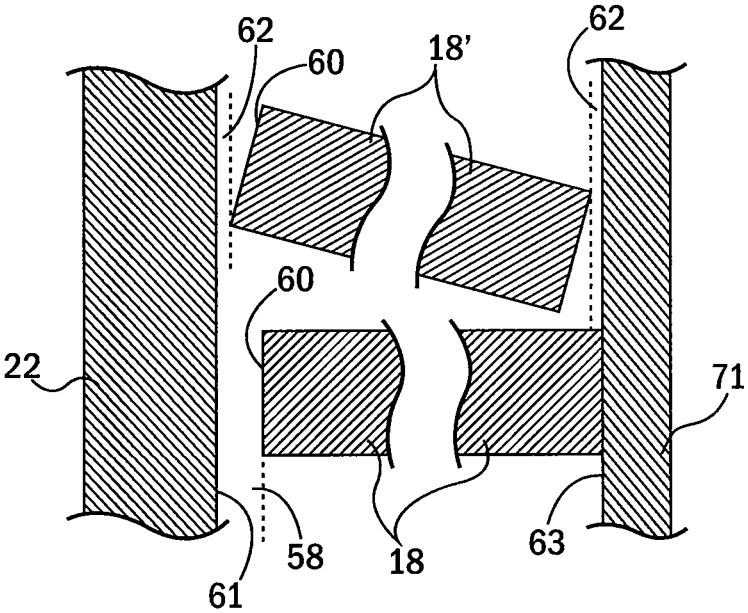

ULTRA LOW-PROFILE SPICE RACK

BACKGROUND OF THE FIRST INVENTION

This invention relates to spice racks and in particular to a spice rack providing improved kitchen space utilization.

Convenient access to cooking spices can greatly simplify the preparation of many recipes. Countertop spice racks can display multiple spice containers within easy reach, but suffer from the drawback of using scarce counter space and exposing the spices to light and heat which may decrease their life. For this reason, many cooks store spices within the kitchen cabinets above the counters. Such cabinets provide ample storage space but can make it difficult to view and access spice containers to the extent that the frontmost spice containers block those at the rear. Alternatively, positioning the spices all to the front of the shelves, in front of other kitchen sundries, risks dislodging the spice containers when the larger objects are removed.

For these reasons, it is known to mount spice racks on the interior face of the cabinet doors themselves. When the doors are opened, the spices are readily visible in the single plane of the door. Spice racks of this kind are taught, for example, in U.S. Pat. No. 2,122,336 to Barry issued Jun. 28, 1938.

The space available on the inside of a cabinet door is limited by the need to prevent interference between the spice rack on the door and the shelves and items on the shelves. For this reason the spice racks must be generally positioned in areas away from the shelves and the items on the shelves must be positioned away from the shelf edges to provide room for the spice rack when the door closes.

Retaining the spice containers in the door-mounted spice racks when the cabinet door is opened is normally provided by "guardrails" on the shelves attached to the cabinet door. These guardrails can obscure the spice containers and their labels and require a lifting of the spices out of the shelves necessitating ample spacing between the spice racks for this movement.

Such shelf systems practically have limited storage capability and require the use of multiple cabinet doors if large numbers of spices are to be stored, an approach which reduces the ability to access the spices easily.

SUMMARY OF THE FIRST INVENTION

The present invention provides a spice rack that utilizes the unused volume between the shelves and the cabinet door defined by the thickness of the face frame against which the cabinet door fits. By employing extremely low-profile spice containers and a thin spice container supporting structure, a hitherto unused portion of the cabinet and kitchen are rendered usable for the spice storage.

One embodiment of the present invention provides a spice holding system including a cabinet having a cabinet volume accessible through a face frame defining a cabinet opening, the cabinet providing a door hingeably covering the cabinet opening by moving between an opened position allowing access through the cabinet opening and a closed position overlaying the face frame with an inner surface of the door proximate to an outer face of the face frame, the face frame having a first thickness measured perpendicularly to a plane of the outer face of the face frame between the outer face of the face frame and an inner face of the face frame, the cabinet further providing at least one shelf supported horizontally within the cabinet volume and having a front edge displaced rearward from the inner face of the face frame by a clearance distance allowing insertion and removal of the shelf into and from the cabinet volume by a tipping of the shelf away from a horizontal plane. A spice container support is attached at a rear surface to the inner surface of the door to be positioned within the face frame when the door is closed, the spice container support having a second thickness measured perpendicularly to a plane of the inner surface of the door and between the rear surface of the spice container support and an exposed first attachment surface of the spice container support. A plurality of spice containers each having a second attachment surface are releasably attached to the first attachment surface of the spice container support, the spice containers providing a third thickness measured between the second attachment surface and an opposed front surface of the spice containers wherein the sum of the second and third thickness is substantially less than a sum of the first thickness and the clearance distance.

It is thus a feature of at least one embodiment of the invention to take advantage of conveniently located and generally unused space within a cabinet. Unlike conventional shelves, existing shelf storage space is not encroached upon.

The sum of the first and second thickness may be substantially less than 1 inch or substantially less than 15/16 of an inch. In addition to or alternatively the third thickness may be substantially no greater than 7/8 of an inch.

It is thus a feature of at least one embodiment of the invention to provide a spice rack which works with standard cabinets.

The spice containers may be rectangular prisms having transparent front surfaces It is thus a feature of at least one embodiment of the invention to provide a space efficient form factor dense packing that nevertheless allows ready visual inspection of the package contents.

The spice holding system may include spice containers which provide an opening in a wall extending between the second attachment surface and the front surface that may be positioned upward when the spice container is positioned on the first attachment surface.

It is thus a feature of at least one embodiment of the invention to position the lid of the spice containers upward during storage to prevent spillage.

The opening is a living hinge.

It is thus a feature of at least one embodiment of the invention to provide a quickly openable lid that is readily manufactured without a need to be constructed of the transparent material.

The spice containers are a moldable transparent thermoplastic.

It is thus a feature of at least one embodiment of the invention to provide ready visual inspection of the interiors of the spice containers when stored on the door.

The spice containers may further include a spice label positioned on the front surface and having an aperture revealing a content of the spice container through the transparent front wall.

It is thus a feature of at least one embodiment of the invention to provide additional information about the spices using a label while allowing inspection of the spices within the container The aperture may be positioned approximately midway along the height of the front surface.

It is thus a feature of at least one embodiment of the invention to provide a visual display of the spices augmenting spice selection during most of the use of the spice container.

The aperture may be fully blocked by spices when the container is two thirds full or more.

It is thus a feature of at least one embodiment of the invention to eliminate consumer confusion caused by settling of spices during shipment.

The aperture may be fully unblocked by spices when the container is ⅙ full or less.

It is thus a feature of at least one embodiment of the invention to provide an indication of when new spices should be ordered.

The first and second attachment surfaces may be magnetically attracted materials.

It is thus a feature of at least one embodiment of the invention to provide a low profile attachment method that allows complete flexibility in arranging of the spices within the storage volume.

The first attachment material may span an intersection of the plane of the shelves and the inner surface of the door so that the spice containers may be attached at this intersection.

It is thus a feature of at least one embodiment of the invention to fully utilize unused space in the cabinet including adjacent to shelves.

The spice containers may be mountable to provide opposed services perpendicular to the attachment surface that may be grasped by a user's opposed thumb and fingers.

It is thus a feature of at least one embodiment of the invention to provide ready access to individual spice containers.

The first and second attachment surfaces may be releasable by movement solely in a direction perpendicular to a plane of the inner surface of the door.

It is thus a feature of at least one embodiment of the invention to allow removal of the spice containers without awkward upward movement and without the need to preserve clearance rooms for upward movement.

These particular features and advantages may apply to only some embodiments falling within the claims and thus do not define the scope of the invention.

BRIEF DESCRIPTION OF THE FIGURES OF THE FIRST INVENTION

FIG. 3 is an elevational side cross-sectional view of the cabinets of FIGS. 1 and 2 showing the space between the rear surface of the cabinet door when the cabinet door is closed and a front edge of the shelf of the cabinet such as may receive the spice containers of the present invention;

FIG. 4 is an elevational side cross-section in partial fragment of the shelves of FIG. 3 as fit between a rear wall of the cabinet and the inner surface of the cabinet door showing a necessary clearance when the shelf is in the horizontal position resulting from a need to remove the shelves without camming during upward tipping of the shelves;

Figure 1:
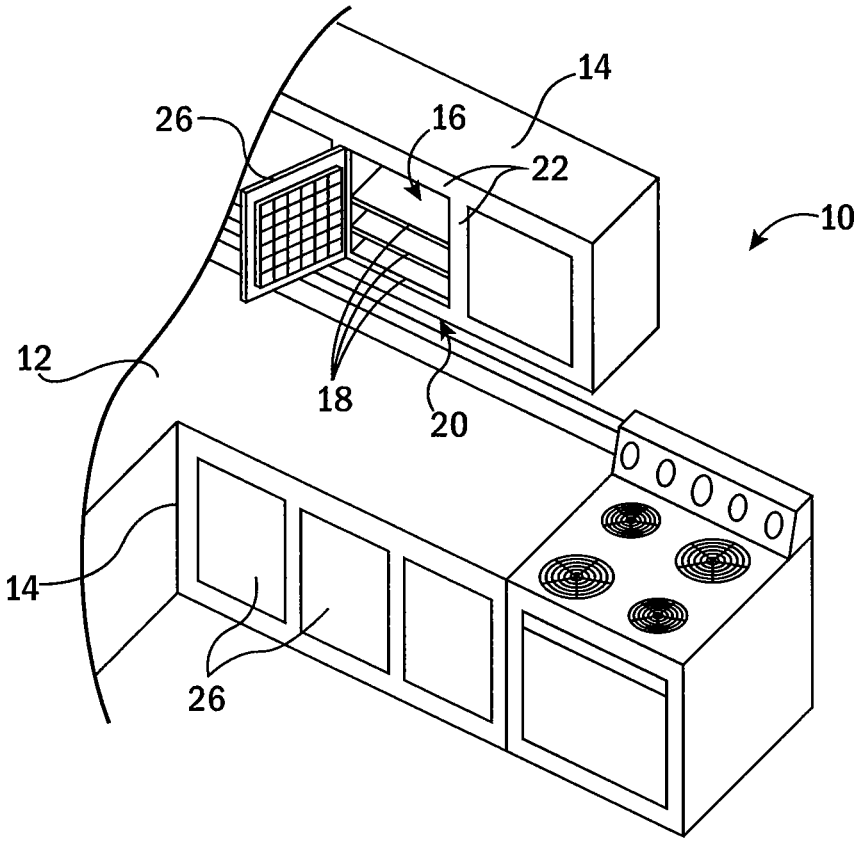
FIG. 1 is a perspective view of a typical kitchen cabinet positioned above a cooking area and showing an open cabinet door providing high density support of spice containers per the present invention.
Figure 11A:
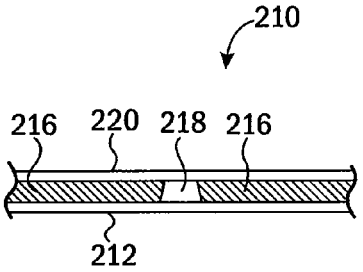
Figure 11B:
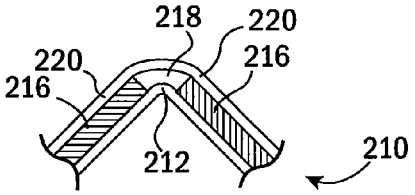

FIG. 11*a* and 11*b* are fragmentary cross-sections through the fold lines of FIG. 1 showing a spacing of the reinforcing cardboard panels to permit hinging without tearing of an outer paper surface of the gameboard.

Figure 10:
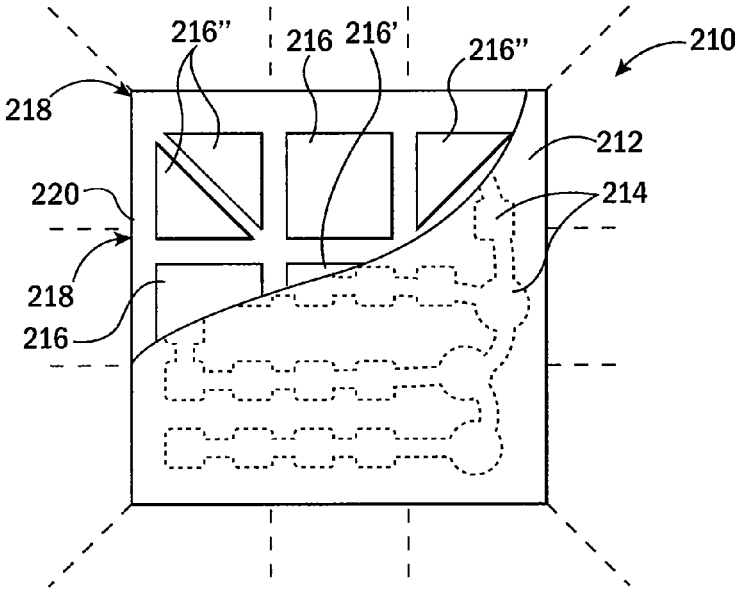
FIG. 10 is a top plan view in partial cutaway of the gameboard of the present invention showing reinforcing cardboard interior panels spaced to provide for fold or hinge lines in the gameboard.
Figure 12:
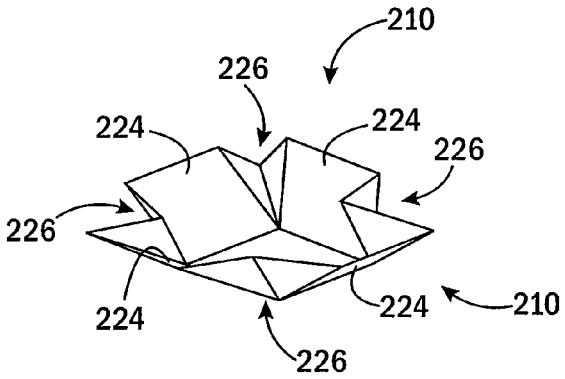

FIG. 12 is a simplified perspective view of the initial steps of a folding of the gameboard of FIG. 10 into a container bottom and upstanding sidewalls.

Figure 13:
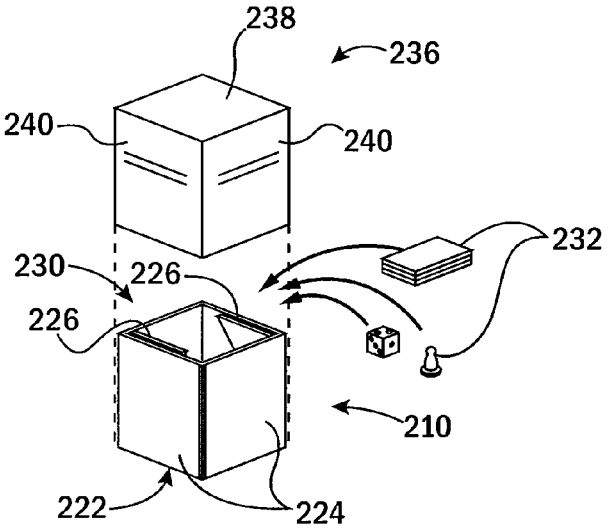

FIG. 13 is a perspective view of the gameboard as fully folded showing the ability to receive game tokens and pieces in the container formed by the gameboard before being covered by an outer complementary sliding lid.

Figure 14:
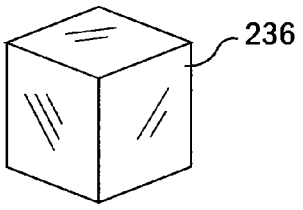

FIG. 14 is a perspective view of the gameboard and lid fully assembled and shrink-wrapped for retail merchandising.

Figure 15:
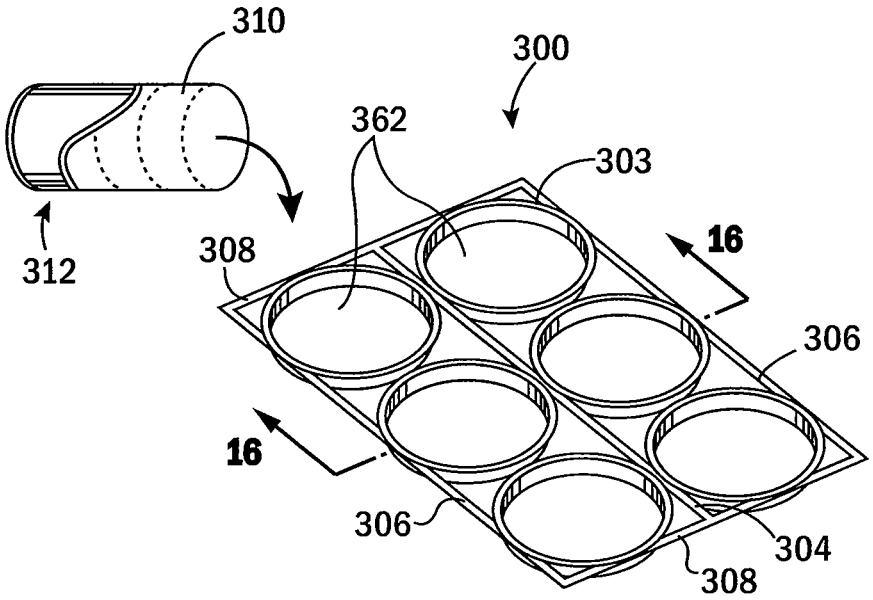
Figure 16:
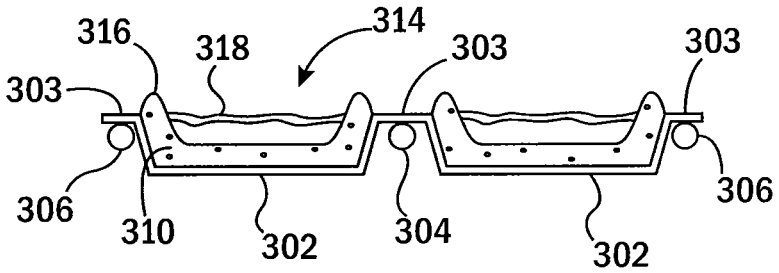

FIG. 15 is a perspective view of one embodiment of the baking pan of the present invention showing multiple shallow circular pans attached together to conform to a standard baking sheet form factor; and FIG. 16 is a cross-section along line 16-16 of FIG. 15 of the pan holding assembled mini-pizzas.

DETAILED DESCRIPTION OF THE PREFERRED EMBODIMENT OF THE FIRST INVENTION

Referring now to FIG. 1, a kitchen 10 may provide a working counter surface 12 having kitchen cabinets 14, for example, positioned beneath the working counter surface 12 or on the wall above the counter surface 12.

Figure 2:
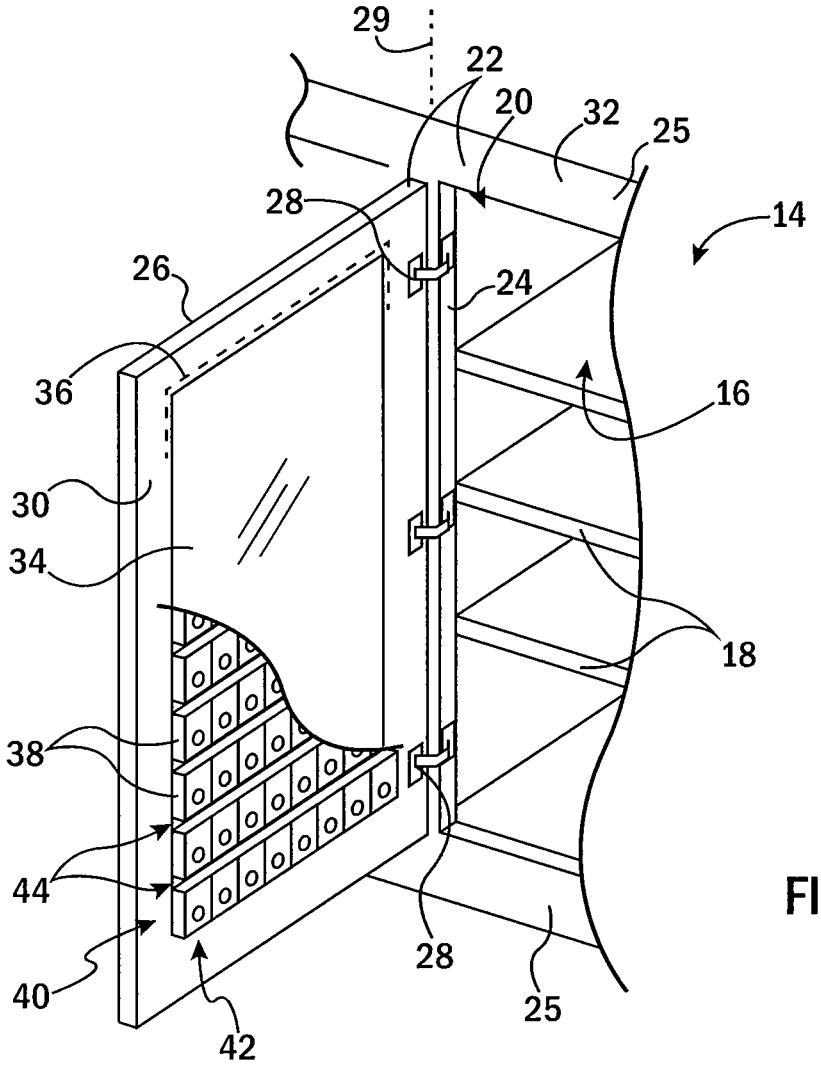
FIG. 2 is a detailed fragmentary view of the cabinet door of FIG. 1 showing a first embodiment of a spice container support surface with spice containers in partial cutaway positioned on that surface.

Referring also to FIG. 2, the cabinets 14 provide cabinet volumes 16 partitioned by one or more horizontally extending and mutually parallel shelves 18 spaced at various heights within the cabinet volume 16 providing storage surfaces for kitchen sundries (not shown in FIG. 1) within the cabinet volume 16 as is generally understood in the art.

The cabinet volume 16 is accessible through a cabinet opening 20 bounded by inner edges of a face frame 22 typically comprising vertically extending styles 24 extending between upper and lower horizontally extending rails 25. Generally the shelves 18 extend in the cabinet volume 16 to the left and right of the inner edges of the face frame 22 reflecting the fact that the cabinet volume 16 is greater in cross-sectional area than the cabinet opening 20. A front edge of the shelves 18 abuts a rear surface of the face frame 22 and extends behind the face frame 22 in order to provide the maximum storage surface and to eliminate the risk of materials falling down from the sides of the shelves 18 within the cabinet volume 16.

Cabinet doors 26 may be attached to the cabinets 14, for example, by hinges 28 extending between an edge of the cabinet door 26 and one side of the cabinet opening 20 (typically the face frame 22), allowing the cabinet doors 26 to pivot about a vertical axis 29 to swing between an opened position providing access to the cabinet volume 16 (as shown in the upper cabinets of FIG. 1) and a closed position (shown in the lower cabinets of FIG. 1) covering the opening 20 and blocking access to the cabinet volume 16. In the closed position, an inner face 30 of the cabinet door abuts an outer surface 32 of the face frame 22, while in the opened position the inner face 30 of cabinet door 26 extends away from a plane of the face frame presenting a generally planar vertical inner face 30 accessible to a person using the counter surface 12.

Referring still to FIG. 2, a ferromagnetic sheet 34 may be attached to the inner face 30 of the cabinet door 26 within a periphery 36, the latter describing a projection of the inner edges of the face frame and hence the cabinet opening 20 against the inner face 30 when the cabinet door 26 is in the closed position. Thus, the ferromagnetic sheet 34 does not interfere with the face frame 22 when the cabinet door 26 is closed.

The ferromagnetic sheet 34 provides a spice container support to which multiple spice containers 38 may be attached by means of attachment surfaces (for example, magnets) on the rear of the spice containers 38 as will be described below. In a preferred embodiment, the spice containers 38 are generally rectangular parallelepipeds that may be arranged in multiple horizontal rows 40 and vertical columns 42 within a plane parallel to the inner face 30 with either the rows 40 or the columns 42 spaced by finger gaps 44 as will be described below.

In one nonlimiting example, the spice containers 38 may have a horizontal width of 2 inches measured along the plane of the inner face 30, a vertical height of 2¾ inches also measured along the plane of the inner face 30 and a thickness measured perpendicular to a plane in the inner face 30 of ⅞", all being measurements when the spice containers 38 are attached to the ferromagnetic sheet 34. A standard size cabinet door 26 may hold as many as ten rows and seven columns or seventy spice containers for a total storage area of as much as 336 cubic inches or approximately 6 quarts.

Referring now to FIGS. 2 and 3, when the cabinet door 26 is closed and abutting a front surface of the face frame 22, a rear surface 50 of the spice containers 38 will be spaced from the inner face 30 of the cabinet door 26 by a support thickness 52 being a thickness of the ferromagnetic sheet 34 and the attachment element on the spice container 38 (the latter to be described below). This support thickness 52 separates a rear surface of the spice container 38 from the inner face 30 of the cabinet door 26 and may be practically negligible and less than 1/16 of an inch.

The thickness 54 of the spice container 38 of up to ⅞ inches then provides a total projection of the spice containers 38 from the inner face 30 of approximately ⅞ inches. The bulk of this projection is within a thickness 56 of the face frame 22, a space which is generally unused as will be explained below. Approximately ¼ of an inch of the spice containers 38 projects inward beyond a rear surface of the face frame 22 into a clearance zone 58 being a gap between a front edge 60 of the shelves 18 and the rear surface of the face frame 22.

Referring to FIG. 4, the clearance zone 58 is enforced in most cabinets 14 by a desire to allow the cabinet shelves 18 to be adjusted by tipping the cabinet shelves 18 upward at an angle (shown by shelf 18') which increases the horizontal extent of the shelf 18' caused by the general principle that the diagonal of a rectangular cross-section of the shelf 18 is longer than any one side of the shelf 18 measured along a plane of the shelf 18. To prevent jamming of the shelf 18 between a rear surface 61 of the face frame 22 and a front surface 63 of a cabinet backwall 71, the length of the shelf 18 with respect to a separation between a rear surface 61 of the face frame 22 and a front surface 63 of a cabinet backwall 71 is reduced by about ¼ inch for standard size shelf. This reduction in length may include tolerance allowances 62 (in addition to the nominal amount allowed to prevent jamming) to accommodate reasonable manufacturing tolerances for shrinkage and warpage. Accordingly, the present inventor has determined that a clearance zone 58 of approximately ¼ inch or more is provided in most cabinet shelves 18.

Referring again to FIG. 3, fitting the spice containers 38 and the ferromagnetic sheet 34 within the sum of the clearance zone 58 and the thickness of the face frame 22 allows the spice containers 38 be positioned freely over the inner face 30 of the cabinet door 26 including in positions of the inner face 30 intersecting zones 64 defined by horizontal projections of the shelves 18 toward the inner face 30 of the cabinet door 26 where there might be interference between the spice container 38 and the front edge of the shelf 18. It should be noted that the extent of the shelf 18 serves as a proxy for limits to the forward location of kitchen sundries 66 which are normally placed on the shelves 18 to be fully supported thereby.

Accordingly by dimensioning the sum of the thicknesses 52 and 54 to be less than a sum of the thickness 54 of the face frame 22 and the clearance zone 58, a substantial volume of unused space may be reclaimed without loss of other cabinet space. Generally, the total thickness 52 plus thickness 54 will be less than 1 inch, or less than 15/16 of an inch and the thickness 54 will be substantially no greater than ⅞ of an inch.

Figure 5:
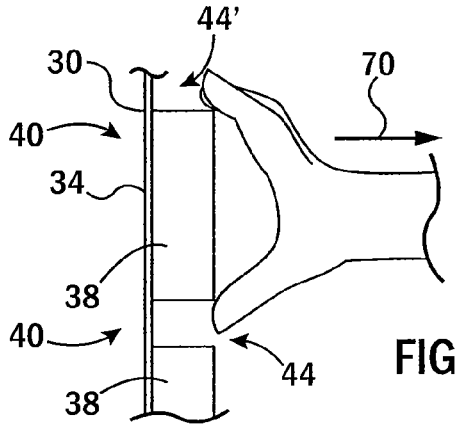
FIG. 5 is a side elevational view of the cabinet door of FIG. 2 showing a spacing of the spice containers for easy removal in a direction perpendicular to the plane of the cabinet door.

Referring now to FIG. 5, as noted, the spice containers 38 may be arranged in rows 40 to provide for finger gaps 44 of approximately ½ inch to ¾ inches allowing removal of the spice containers 38 in a direction 70 generally perpendicular to the inner face 30 of the cabinet door 26 by grasping the top and bottom surface of the spice containers between the thumb and fingers. This eliminates wasted space in the storage area of the inner face 30 that would be required if it were necessary to lift the spice container 38 vertically, for example, to remove it from a conventional shelf having a pocket or retention rail intended to hold the spice container 38 from dislodgment during opening of the cabinet door 26. This perpendicular direction 70 of removal of the spice containers 38 allows the finger gaps 44 to be relatively small increasing the storage area. It will be appreciated that finger gaps 44 may alternatively or in addition be between columns 42 of the spice containers 38.

Figure 6:
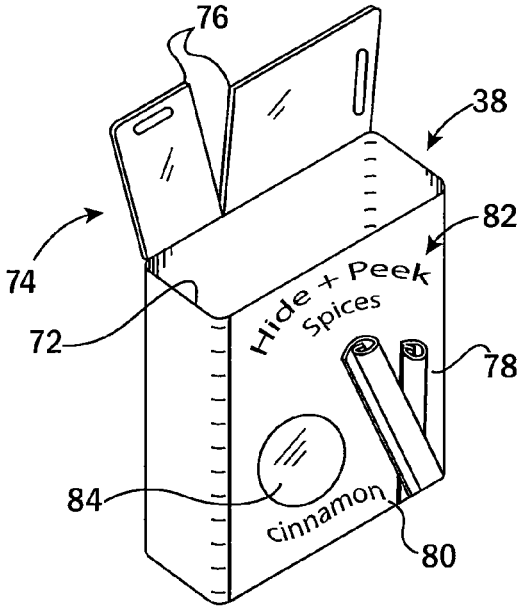
FIG. 6 is a front perspective view of a spice container showing a window revealing the spice within the container.
Figure 7:
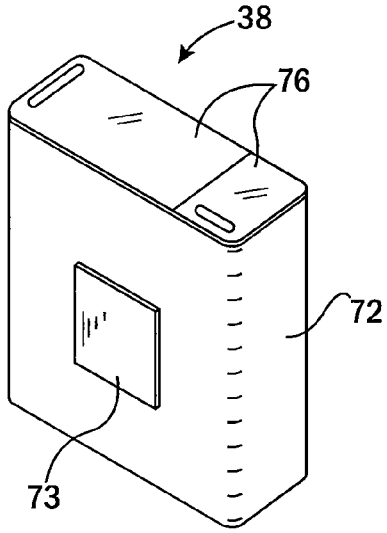
FIG. 7 is a rear perspective view of the spice container of FIG. 6 showing an attachment surface including a magnetic square.

Referring now to FIGS. 6 and 7, in one embodiment of the invention, the spice containers 38 may have their bodies 72 (comprising side and bottom walls) constructed of the transparent thermoplastic material to provide a generally rectangular container open at the top. A lid assembly 74 may be constructed of a flexible thermoplastic material and attached to the body 72 providing one or more lid elements 76 hinging about one edge of the upper opening, for example, using a living hinge construction to provide selective access to the interior of the spice container 38, for example, through different size openings. The lid assembly 74 may also include sifting elements (not shown) to meter the dispensing of spices contained within the spice container 38.

In one embodiment, a paper or polymeric label 78 may be attached to the front wall exposed to a user when the cabinet door 26 is open and optionally side walls providing a labeling of the contained spice 80, a brand-name 82, and a window 84 through which the contained spices may be visible as will be described further below.

As shown in FIG. 7, a rear surface of the body 72 may provide for a magnet strip 73 providing an attachment surface having negligible thickness for attaching the spice container 38 to the ferromagnetic sheet 34 of FIG. 2. It will be appreciated that this construction which permits of visibility of the spices through a non-lid surface in a rectangular container greatly increases the storage efficiency of the system.

Figure 8:
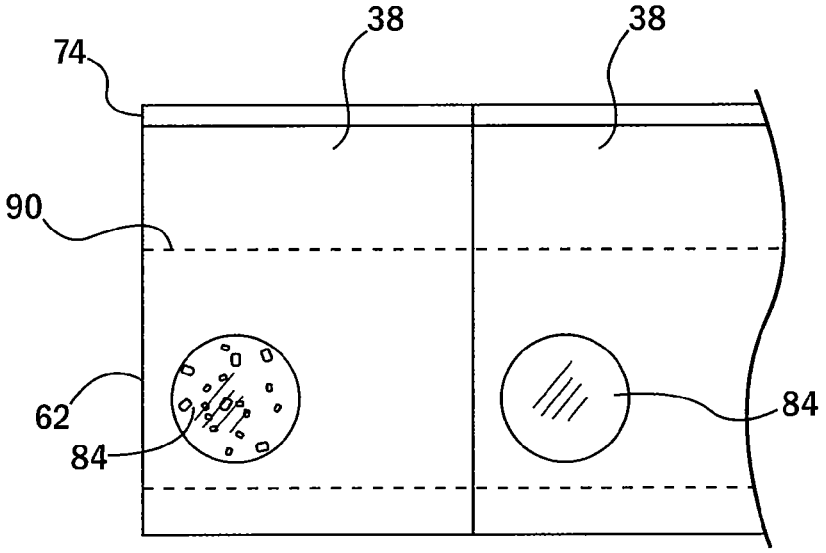
FIG. 8 is a front elevational view of two spice containers of FIG. 6 showing positioning of the window to reveal a supply of spice after typical settling during shipment of the spice container.

Referring now to FIG. 8, in one embodiment, the window 84 may be positioned approximately midway along the height of the front surface of the spice container 38. Desirably, the window 84 is sized and positioned to be visually fully filled by spices 91 when the spice container 38 is filled to a level 90 of two thirds or more. This ensures that customers of prepackaged spice containers 38 are not unduly concerned by normal settling of the spices during shipping. Similarly, the window 84 is sized and positioned to reveal no contained spices when the container is less than ⅙ full so as to indicate that a new purchase of spices should be planned.

Figure 9:
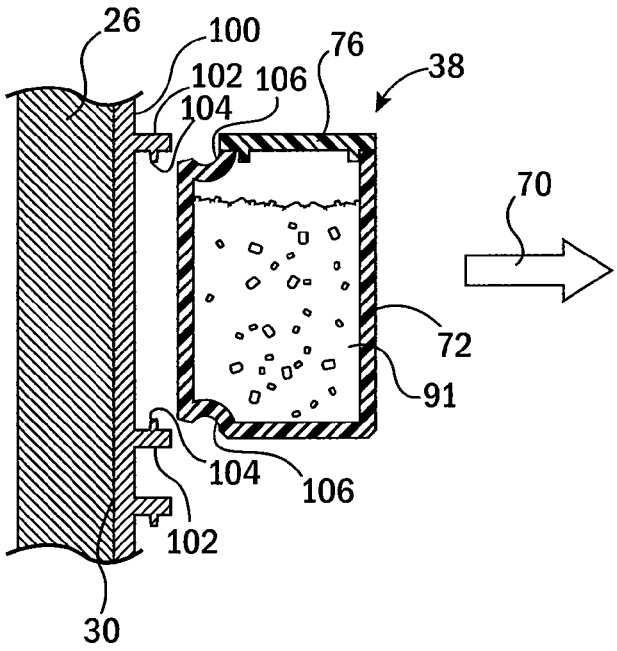
FIG. 9 is a side elevational view of the door of FIGS. 1 and 2 for an alternative embodiment using a polymeric attachment surface providing a snap fit of the spice containers to the support surface.

Referring now to FIG. 9, other systems of attaching the spice containers 38 to the inner face 30 of the cabinet door 26 are contemplated to be within the scope of the present invention including, for example, a support surface 100 functionally replacing the ferromagnetic sheet 34 and being, for example, a molded thermoplastic material having collars 102 for receiving the periphery of the spice containers 38. The retention of the spice containers 38 may be provided by inter-engaging teeth and grooves, with the periphery having inwardly extending teeth 104 engaging with corresponding grooves 106 in the upper and lower walls of the body 72 providing a snap fit releasable in direction 70 as before.

In yet another embodiment, the attachment between the spice containers 38 and the cabinet door 26 may comprise hook and loop fastener-type material, for example, similar to or that sold under the Velcro tradename.

It will be appreciated that the support surface provided by the ferromagnetic sheet 34 or the support surface 100 need not extend over the entire inner surface of the cabinet door 26 but may be sold in portions that cover only a portion of the inner surface of the cabinet door 26 to provide for more compact transportation and convenient installation. The portions may be as small as one row 40 of spice containers 38, for example. In this case, or in the other embodiments described above, the attachment surface attached to the cabinet door 26 may in fact be a magnetic strip, for example a flexible polymeric magnetic material, that may be adhered to the inner surface 30 of the cabinet door 26 and the attachment element on the spice containers 38 may be a ferromagnetic material such as a strip of iron or iron containing material.

CONTAINER FOR GAME PROVIDING GAMEBOARD

Background of the Invention

This invention relates to games and toys and in particular to a container for a board game in which a portion of the container provides the gameboard.

Board games are games typically using tokens or pieces located or moved over a printed board surface. Board games include ancient games such as chess and checkers as well as more modern counterparts such as Monopoly® and the like.

Modern implementations of the board game often use a paper or cardboard board surface that may be folded to fit within a shallow box receiving the flat folded board and having a periphery substantially equal to the dimensions of the flat folded board. The box provides a height of several inches to hold game play pieces such as cards tokens and the like.

SUMMARY OF THE SECOND INVENTION

The present invention provides a gameboard that, rather than folding flat, folds into an upwardly open container having a bottom wall and upstanding sidewalls to receive and retain cards, tokens, and the like. A lid providing a top wall and downwardly extending sidewalls fits around the folded gameboard to provide an enclosed container where the bottom wall of the folded gameboard forms the bottom wall of the container and the sidewalls of the container are provided by the overlapping sidewalls of the folded gameboard and the lid sidewalls.

The present inventor has recognized that this configuration may in fact reduce the cubic dimensions or volume of the container for standard sized board games thereby reducing a substantial component of the freight cost. The compact configuration further provides for an improved number and size of the game facings on the shelf incident to the greater height of the sidewalls and narrower footprint. In addition, eliminating the need for a separate box bottom reduces packaging costs and environmental impact.

These particular features and advantages may apply to only some embodiments falling within the claims and thus do not define the scope of the invention.

Detailed Description of the Preferred Embodiment of the Second Invention

Referring now to FIG. 10, a gameboard 210 per the teachings of the present invention may provide for an upper planar paper, vinyl or similar flexible sheet layer 212, for example, having a square perimeter and having printed game-play indicia 214 on its upper surface upon which tokens or similar pieces may be moved per the rules of the particular game. The present invention is not limited to a particular set of game rules or pieces.

Underlying the upper planar layer 212 are a set of substantially stiff panels 216, for example, of cardboard fitting together to tile the area covered by the upper layer 212 and yet to be separated by narrow channels or gutters 218 as will be described further below. In a preferred embodiment, the panel 216 provides five square panels 216 arranged in a cross about a central square panel 216', each square panel 216 and 216' having a height and width being approximately ⅓ the height and width of the layer 212 minus the width of the gutters 218.

Between the arms of the cross formed by the square panels 216 and 216', providing areas substantially equal to the area of one square panel 216, are positioned two right isosceles triangular panels 216" fitting together to fill this space with a gutter 218 and together to occupy substantially the area of one square panel 216. An interface between the right isosceles triangular panels 216" provides a gutter oriented along an axis intersecting the center of the center panel 216'.

A second layer 220 of paper or vinyl may be placed below the panels 216 substantially equal in size to the layer 212 to be seamed to the layer 212 to sandwich the panel 216 between layers 212 and 220. Typically the panels 216, 216' and 216" will be glued or otherwise affixed to the layers 220 and 212 to provide a smooth and substantially rigid board playing system when the gameboard 210 is in its planar unfolded configuration as shown in FIG. 10.

Referring now to FIGS. 11*a* and 11*b*, the gutters 218 between the panels 216 are bridged by the upper layer 212 and the lower layer 220 so that a folding of the gameboard 210 moves the panels 216 from a coplanar position to a respectively angled position which will allow the layers 212 and 220 to provide a living hinge between the panels 216 without the risk of tearing.

Referring now to FIG. 12, the gameboard 210 may be folded so that a central square base portion 222 of the gameboard overlying the central panel 216' may provide a base portion 222 about which the remainder of the gameboard 210 may fold upward to provide upwardly extending sidewalls 224 and inwardly folding gusset portions 226, where the sidewalls 224 are formed from portions of the gameboard 210 attached to the panels 216 and the gussets are formed by portions of the gameboard 210 about the panels 216".

As shown in FIG. 13, when fully folded, the gameboard 210 provides an upwardly open box structure having sidewalls 224 extending substantially perpendicularly to the base portion 222 and the gusset portions 226 foldable against the inner surface of the sidewalls 224 to present an open cavity 230 into which game pieces 232 may be inserted for shipping and storage. Such game pieces 232 may include cards, instruction materials, tokens, spinners, and dice and other elements well known in the art of board games.

In this fully folded configuration, a lid 236 may fit down over the gameboard 210 to retain it in the folded position, the lid providing an upper panel 238 substantially equal to the area of the base portion 222 and downwardly extending sidewalls 240 that may fit parallel to and outwardly adjacent to the sidewalls 224 holding the gameboard 210 in its folded configuration. As assembled, the lid 236 and the folded gameboard 210 provide a box whose outer walls are comprised of upper panel 238, sidewalls 240 and a lower surface of the base portion 222. The sidewalls 240 may be imprinted with merchandising information 242 as may be the bottom surface of the base portion 222 which provides a lower surface of the gameboard 210 not normally visible during gameplay.

It will be appreciated that the central panel 216' may, in fact, be any rectangular shape to permit the invention to be used with rectangular prism as well as cubic boxes with appropriate adjustments of the dimensions of other panels 216.

The invention may generally provide a gameboard comprising: a rectangular upper flexible and lower flexible sheet, the upper flexible sheet providing a printed gameplay surface; a set of substantially rigid rectangular panels sandwiched between the upper flexible and lower flexible sheet, the panels arranged in three rectilinear rows and columns, with corner panels subdivided along diagonal lines passing between opposite corners of the upper flexible and lower flexible sheets; whereby the gameboard may fold into a substantially rectangular box open at a top.

MINI-PIZZA PAN

Background of the Invention

This invention relates to cookware and in particular to a baking pan having multiple depressions for mini-pizzas.

Pizza is a baked flatbread typically topped with a tomato sauce and cheese. Pizza may be enjoyed in the home setting through a variety of options including carry out, delivery, frozen pizza, and partially baked pizza crusts that may be topped by the consumer.

Summary of the Third Invention

The present invention provides a baking pan and method for convenient preparation of mini pizzas in a conventional oven. The baking pan provides a set of shallow pans sized to convert a single biscuit from commercially refrigerated biscuit dough into a properly sized mini pizza crust that may be topped as desired by the home chef.

Detailed Description of the Preferred Embodiment of the Third Invention

Referring to FIG. 15, a mini-pizza baking pan 300 per the present invention may provide a series of individual pans 302 arranged into two columns and three rows. Each pan 302 provides a substantially circular and flat base surrounded by an upstanding sidewall terminating at a radially outwardly extending flange 303. Preferably, the pans 302 are drawn sheet steel that may be plated to resist corrosion although aluminum which may be anodized may also be used. The upper surface of the pans 302 may be coated with a nonstick surface such as a polytetrafluoroethylene material.

The columns of pans 302 may be joined together by a metallic support bar 304 passing horizontally between the columns to which the flange 303 of each pan 302 may be spot welded at a tangent point or attached by other well-known means. Outer support bars 306 may flank the columns and be attached at their ends along with the ends of the metallic support bar 304 to upper and lower support bars 308 to form a generally rectangular frame supporting the pans 302. Overlapping portions of the flanges 303 of the pans 302 may be welded to these outer support bars 306 and upper and lower support bars 308 as well. In addition, overlapping flanges 303 of adjacent pans 302 in each column may also be attached to each other by spot welding or other means to provide an integrated assembly having dimensions of approximately 12 by 18 inches comporting with a standard cookie sheet size to permit use in most ovens and ready storage. The bars 304, 306, and 308 may be, for example 3/16 steel rods formed and welded together.

Each pan 302 presents an upwardly open shallow cylindrical vessel having a dimension of substantially six inches in diameter and one half inch in depth although the depth may be readily varied to be as much as one inch and as little as one quarter inch. The area of the base of the pan will be approximately 28 square inches. Desirably, the volume of each pan 302 is such as to receive a single serving or biscuit 310 from a can 312 of refrigerated biscuits such as Pillsbury Grands®, commercially available from General Mills, Inc. of Minneapolis, Minn. Each biscuit 310 is approximately 58 grams by weight and provides a heat acting leavening ingredient, flour, and shortening as is understood in the art.

Referring to FIG. 16, the biscuit 310 may be pressed by hand into the trays 306 to flatten the biscuit, the form factor of the biscuit 310 expanding its diameter as guided by the dimensions of the pan 302, and to provide a slightly depressed center section 314 and upper rimming crust 316 that may receive toppings 318 therein such as tomato sauce and cheese.

It will be appreciated that the pans 302 need not be circular but may, for example, be square and that they may be arranged in any tiling pattern not necessarily comprising rectilinear rows and columns of the preferred embodiment. Further, it will be appreciated that the pans may be formed in an alternative embodiment from a single sheet of metal shallow drawn to form the pans 302. In this case, the pans are attached together by the common material of the sheet. The pans may be constructed of a 13-18 gauge aluminum or 19-12 gauge steel. In one embodiment, the bottom of the pans 302 may be perforated with holes to allow the escape of water vapor and to produce a crisper crust.

The invention may generally provide for a mini-pizza cookware pan comprising: a set of at least four shallow dishes having substantially planar bottoms with upstanding sidewalls with a height less than one inch, the dishes arranged and attached to each other in columns and rows to provide an integrated cooking unit receivable on an oven shelf, each dish having a bottom surface area of substantially 28 square inches.

Certain terminology is used herein for purposes of reference only, and thus is not intended to be limiting. For example, terms such as "upper", "lower", "above", "below", "clockwise", and "counterclockwise" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

I claim:

1. A spice holding system comprising:

a cabinet having a cabinet volume accessible through a face frame defining a cabinet opening, the cabinet providing a door hingeably covering the cabinet opening by moving between an opened position allowing access through the cabinet opening and a closed position overlaying the face frame with an inner surface of the door proximate to an outer face of the face frame, the face frame having a first thickness measured perpendicularly to a plane of the outer face of the face frame between the outer face of the face frame and an inner face of the face frame, the cabinet further providing at least one shelf supported horizontally within the cabinet volume and having a front edge displaced rearward from the inner face of the face frame by a clearance distance allowing insertion and removal of the shelf into and from the cabinet volume by a tipping of the shelf away from a horizontal plane;

a spice container support attached at a rear surface to the inner surface of the door to be positioned within the face frame when the door is closed, the spice container support having a second thickness measured perpendicularly to a plane of the inner surface of the door and between the rear surface of the spice container support and an exposed first attachment surface of the spice container support; and a plurality of spice containers each having a second attachment surface releasably attachable to the first attachment surface of the spice container support, the spice containers providing a third thickness measured between the second attachment surface and an opposed front surface of the spice containers;

wherein a sum of the second and third thickness is less than a sum of the first thickness and the clearance distance;

whereby the door may be closed without interference between spice containers attached to the spice container support and the shelves or items fully supported above at least one shelf.

2. The spice holding system of claim 1 wherein the sum of the first and second thickness is less than 1 inch.

3. The spice holding system of claim 2 wherein the sum of the first and second thickness is less than 15/16 of an inch.

4. The spice holding system of claim 1 wherein the third thickness is no greater than 7/8 of an inch.

5. The spice holding system of claim 1 wherein the spice containers are rectangular prisms having transparent front surfaces.

6. The spice holding system of claim 1 wherein the spice containers provide an opening in a wall extending between the second attachment surface and the front surface that may be positioned upward when the spice container is positioned on the first attachment surface.

7. The spice holding system of claim 6 wherein the opening is closable by a lid attached at the opening by a living hinge.

8. The spice holding system of claim 1 wherein spice containers provide walls of a moldable transparent thermoplastic.

9. The spice holding system of claim 8 wherein the spice containers further include a spice label positioned on the front surface and having an aperture revealing a content of the spice container through a transparent front wall of the spice container.

10. The spice holding system of claim 9 wherein the aperture is positioned approximately midway along a height of the front surface.

11. The spice holding system of claim 10 wherein the aperture is fully blocked by spices when the container is two-thirds full or more.

12. The spice holding system of claim 10 wherein the aperture is fully unblocked by spices when the container is 1/6 full or less.

13. The spice holding system of claim 1 wherein the first and second attachment surfaces are magnetically attracted materials.

14. The spice holding system of claim 1 wherein the first attachment material spans an intersection of the plane of the shelves and the inner surface of the door so that the spice containers may be attached at this intersection.

15. The spice holding system of claim 1 wherein the spice containers are mountable to provide opposed surfaces perpendicular to the attachment surface that may be grasped by a users opposed thumb and fingers.

16. The spice holding system of claim 1 wherein the first and second attachment surfaces are releasable by movement solely in a direction perpendicular to a plane of the inner surface of the door.

17. A spice holding system comprising:

a spice container support attachable at a rear surface of a cabinet door, the spice container support having a first thickness between the rear surface of the spice container support and an exposed first attachment surface of the spice container support; and a plurality of spice containers each having a second attachment surface releasably attachable to the first attachment surface of the spice container support, the spice containers providing a second thickness measured between the second attachment surface and an opposed front surface of the spice containers;

wherein a sum of the first and second thicknesses is less than 1 inch; and whereby the spice holder system may be attached to an inner surface of a cabinet door and the cabinet door may be closed without interference between spice containers attached to the spice container support and shelves or items fully positioned above the shelves of the cabinet.

18. The spice holding system of claim 17 wherein the sum of the first and second thickness is substantially less than 15/16 of an inch.

19. The spice holding system of claim 17 wherein the second thickness is substantially no greater than 7/8 of an inch.

20. A method of storing spices using a spice holding system having:

a spice container support attachable at a rear surface of a cabinet door, the spice container support having a first thickness between the rear surface of the spice container support and an exposed first attachment surface of the spice container support; and a plurality of spice containers each having a second attachment surface releasably attachable to the first attachment surface of the spice container support, the spice containers providing a second thickness measured between the second attachment surface and an opposed front surface of the spice containers;

wherein a sum of the first and second thicknesses is less than 1 inch;

the method comprising the steps of:

(a) attaching the rear surface of the spice container support to a rear surface of a cabinet door to span a portion of the door intersecting a plane of cabinet shelves;

(b) attaching at least one spice container to the spice container support at a portion of the spice container support intersecting a plane of the cabinet shelves;

whereby a supporting space of the cabinet door is more fully utilized.

* * * * *